United States Patent [19]

Criswell, Jr.

[11] Patent Number: 4,921,567

[45] Date of Patent: May 1, 1990

[54] MACHINE FOR WRAPPING TAPE ON BOBBIN

[75] Inventor: James F. Criswell, Jr., Burbank, Ill.

[73] Assignee: Guardian Electric Manufacturing Co., Chicago, Ill.

[21] Appl. No.: 184,441

[22] Filed: Apr. 21, 1988

[51] Int. Cl.[5] ..... B65H 54/28

[52] U.S. Cl. ..... 156/361; 156/425; 156/446; 156/468; 242/7.08; 242/7.23

[58] Field of Search ..... 242/7.01, 7.08, 7.21, 242/7.22, 7.23, 7.09, 7.15, 7.19, 68.3; 29/605; 156/185, 187, 171, 468, 425, 446, 443, 361

[56] References Cited

U.S. PATENT DOCUMENTS

| | | | |
|---|---|---|---|
| 3,159,907 | 12/1964 | Bloom | 29/605 |
| 3,359,020 | 12/1967 | O'Donnell | 242/68.3 X |
| 3,380,873 | 4/1968 | Angst | 156/446 |
| 3,396,919 | 8/1968 | Vayda | 242/68.3 X |
| 3,616,078 | 10/1971 | Howard | 156/446 Y |
| 3,984,276 | 10/1976 | Stuart | 156/446 X |
| 4,022,391 | 5/1977 | Stein et al. | 242/7.15 X |
| 4,055,310 | 10/1977 | Bonaiti | 242/7.08 |
| 4,157,165 | 6/1979 | Bierman et al. | 242/7.09 |
| 4,269,367 | 5/1981 | Minami et al. | 242/7.08 |

*Primary Examiner*—David Simmons
*Attorney, Agent, or Firm*—Allegretti & Witcoff, Ltd.

[57] ABSTRACT

Machine for spirally wrapping insulating tape on a wire coil bobbin. Chucks for mounting various sized bobbins are detachably connected to a rotating spindle which also moves axially. The speed of rotation is adjustable with respect to the speed of axial movement to control the amount of overlap of spiral winding.

9 Claims, 3 Drawing Sheets

MACHINE FOR WRAPPING TAPE ON BOBBIN

FIELD OF THE INVENTION

This invention relates to a machine for winding adhesive tape on a spool, particularly insulating tape which covers the windings of an electrical coil.

BACKGROUND OF THE INVENTION

Machines for winding tape are known, but they lack the flexibility required to accommodate a large variety of spool sizes. Some may be adjusted with proper tooling, but the tooling is custom made and expensive. Different tooling is required for each bobbin. Changeover and setup is a complex and slow process. As a result, it has been customary in plants where coils are manufactured in a great variety of sizes to apply the insulating tape manually. In such a procedure, the tape must be cut precisely to the width of the bobbin. This method is expensive because of high labor costs, and the waste of tape remnants.

Machines are available which apply tape to a coil by rotating the coil one revolution without any axial movement of the spool. The tape used in such a machine has to be cut to precisely the same width as the length of the coil between the flanges of the spool. Consequently, it is necessary to provide rolls of tape for each bobbin length and to change the roll when a bobbin of a different size is being taped. Using this machine, the coil is covered with one layer of tape.

THE INVENTION

It is the object of this invention to provide a machine of this kind which will accept any size coil with minimum changeover, which uses one standard width tape to conform readily to the uneven surface of the wire in the coil, and which is fast and may be operated safely. The machine of the invention furthermore must permit changeover and setup to be accomplished by an unskilled operator easily and quickly. The machine of the invention accomplishes these objectives by providing a motor for rotating the spool, and a series of chucks sized for the spools to be taped and which can be detachably connected through an adaptor to a motor shaft. Each chuck includes a spindle or pilot which is sized to fit into the cylindrical hole through the center of the spool. The chuck locks the spool against rotation on the spindle by encircling a flange on the spool.

A different chuck is used for each size of spool. The chuck is easily and quickly detached from the motor shaft. The spindle, comprising part of the chuck, is long enough to receive a spool and preferably includes a detent or depressible stop to permit the spool to slide onto the spindle and to prevent the spool from sliding off the spindle after its inner flange has been seated in the chuck.

A carriage on which the motor and chuck assembly is mounted, is adjustable for lateral movement a distance which corresponds to the length of the particular spool or bobbin being taped. The speed of rotation of the spool is coordinated with the lateral movement so that the tape is wound spirally, each revolution overlapping the previous turn. The amount of the overlap is adjustable even to the extent of providing multiple layers of tape across the length of the spool in a single pass. Thus, a standard relatively narrow width tape may be used for any spool length, and for any desired thickness of insulation.

A tape supply roll is rotatably mounted adjacent the chuck on a fixed shaft and locked against a lateral movement. To cut off the tape after the coil has been completely spirally wound, a knife or cutter is mounted on a support between the supply roll and the spindle. In a preferred form of the invention, a rubber roller is provided to bear against the tape and rotates with the spool to ensure a tight connection between the adhesive tape and the wire coiled on the spool.

DETAILED DESCRIPTION OF PREFERRED EMBODIMENT

Figure 1:
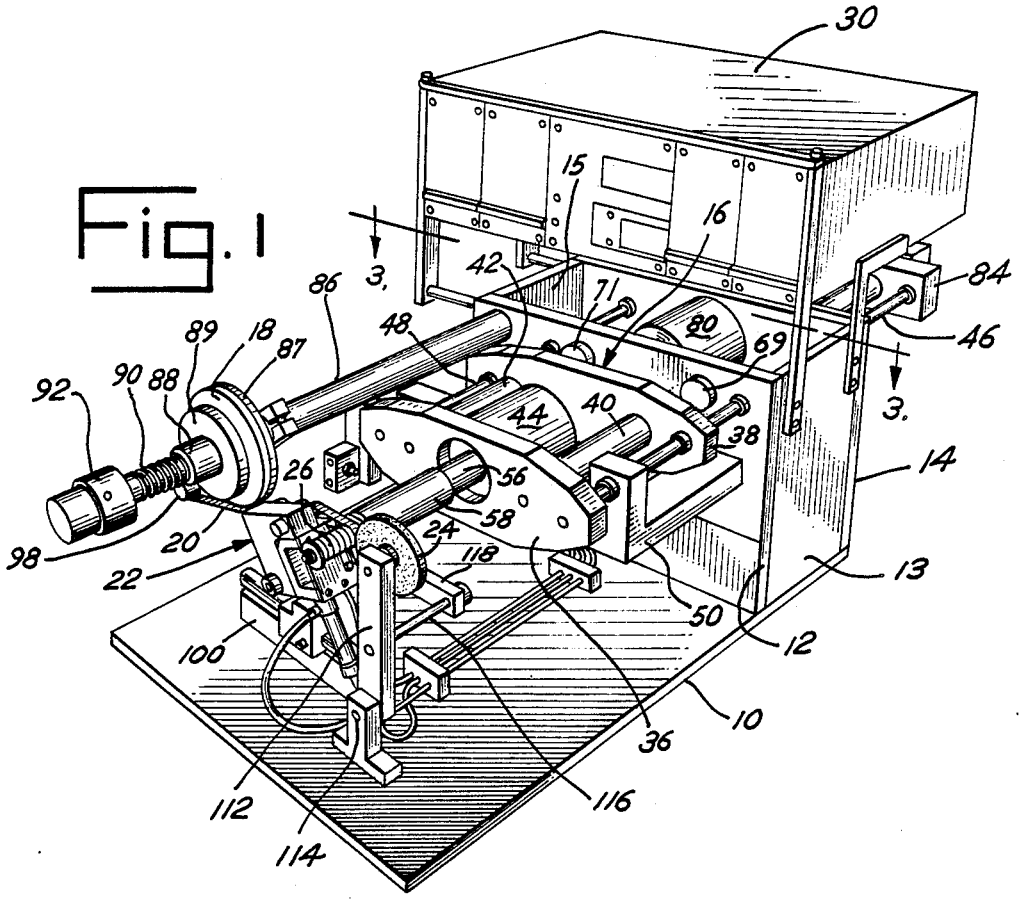
FIG. 1 is a perspective view of a machine constructed in accordance with the invention showing particularly the winding end.

The machine has a frame consisting of a horizontal plate 10, a pair of spaced vertical plates 14, 14 connected by end plates 13, 15. A carriage designated generally at 16 is mounted for back and forth movement on the frame and carries a motor 44 which rotates the chuck 58 and the spindle 60 on the end of the chuck which carries the spool or bobbin 26. The tape is supplied from a roll 18 rotatably mounted on a stationary shaft 86. A support 22 interposed between the supply roll and the spool to be taped is indicated generally at 22. This support carries a vertically movable knife for cutting off the tape after a coil has been wound. Pressure roller 24 mounted pivotally adjacent the spindle serves to press against the tape as the winding occurs to make sure that the tape is adhered tightly to the wire on the coil. A cabinet 30 mounted above the frame houses control mechanism for the motors and the air supply to cylinder 32 which actuates the knife and cylinder 34 for actuating the pressure roller.

The carriage 16 consists of a pair of spaced plates 36, 38 connected together by a pair of shafts 40, 42. A step motor 44 is bolted to the front plate 36. The motor shaft adaptor 56 extends through an opening in the plate 36 and carries the chuck 58. The shaft of a conventional commercial motor is not long enough or of sufficient diameter for purposes of the invention. The motor shaft must not move axially. A thrust bearing may be inserted between the face of the motor and the rear of the adaptor to avoid axial movement. The carriage is mounted for lateral movement back and forth on rods 46, 48 which slide in bearings in the walls of the plates 12, 14 and in the L-shaped bracket 50 rigidly fixed to and projecting from the frame plate 12. The rods 46, 48 extend rearwardly through the rear frame plate 14 and connect to means for moving them back and forth as described below.

Figure 4:
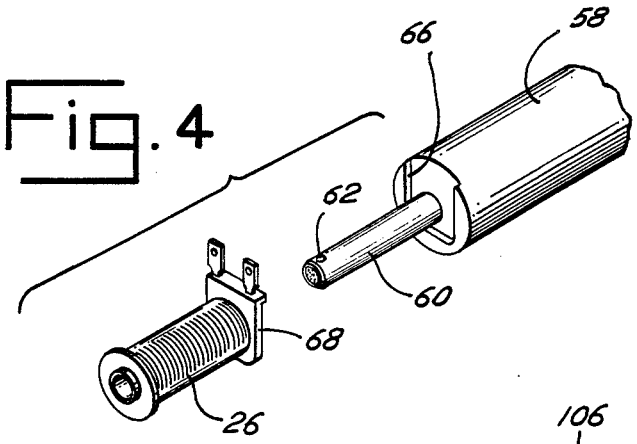
FIG. 4 is a perspective view of the spool and chuck sized to receive the spool.
Figure 7:
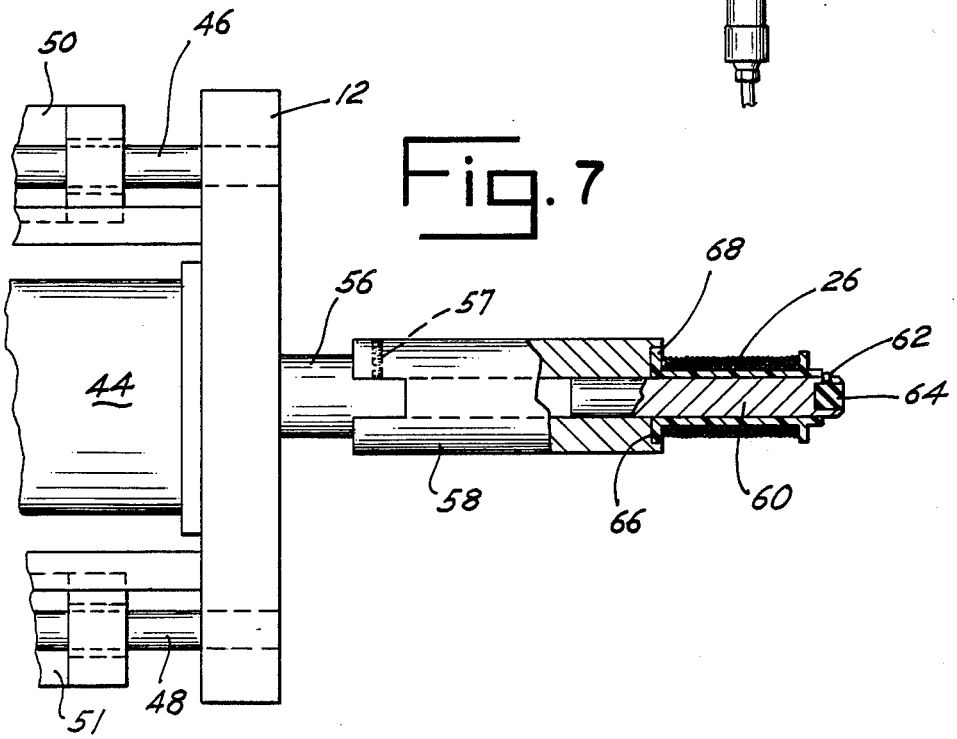
FIG. 7 is an enlarged plan view partly in section showing the outer end of the carriage, the chuck and the spool on the spindle of the chuck.

As shown in FIG. 7, the left end of the detachable chuck 58 is slid onto the end of the motor shaft adaptor 56 and secured by a set screw. The outer end of the chuck carries the spindle 60 on which the spool to be taped is mounted. The length of the chuck is variable depending upon the length of the spool, or bobbin, being wound with tape. In order to bring the inside of the outer flange of spools of varying length into accurate alignment with the tape, the length of the chuck must vary correspondingly. The distance from the inner end of the chuck to inner face of the outer flange of a spool installed on that chuck is constant. The outer or right hand end of the spindle is recessed and mounted in the recess is a rubber spring 64. The spring urges the detent 62 upwardly through an opening in the wall of the spindle. A coil spring can be used rather than the rubber spring if space permits. When the spool is pushed onto the spindle, the detent 62 moves downwardly below the outer surface of the spindle to permit the spool to slide onto the spindle. When the inner flange of the spool 68 has seated on the recess 66 provided in the end of the chuck, the detent 62 is urged above the surface of the spindle by the spring 64 to prevent the spool from sliding off the spindle. The recess 66 in the end of the chuck surrounding the spindle conforms to the configuration of the flange 68 of the spool 26. The flange has at least one flat side so that it is locked to the spindle to rotate when the spindle rotates. Alternatively, a notch in the flange may be used to prevent rotation of the spool with respect to the spindle. This relationship is best shown in FIG. 4 where the configuration of the flange and the cooperating recess is essentially square. The chuck 58 can be removed manually from the end of the motor shaft adaptor 56 by releasing the set screw and replacing the chuck with another of a different size to accommodate a different spool length and/or spool diameter. The spindle 60 is a separate detachable unit from the chuck. Spools of the same length but with a different sized center hole can use the same chuck. Only the spindle attached to the chuck need be changed to accurately fit the center hole of the spool, or bobbin.

Figure 3:
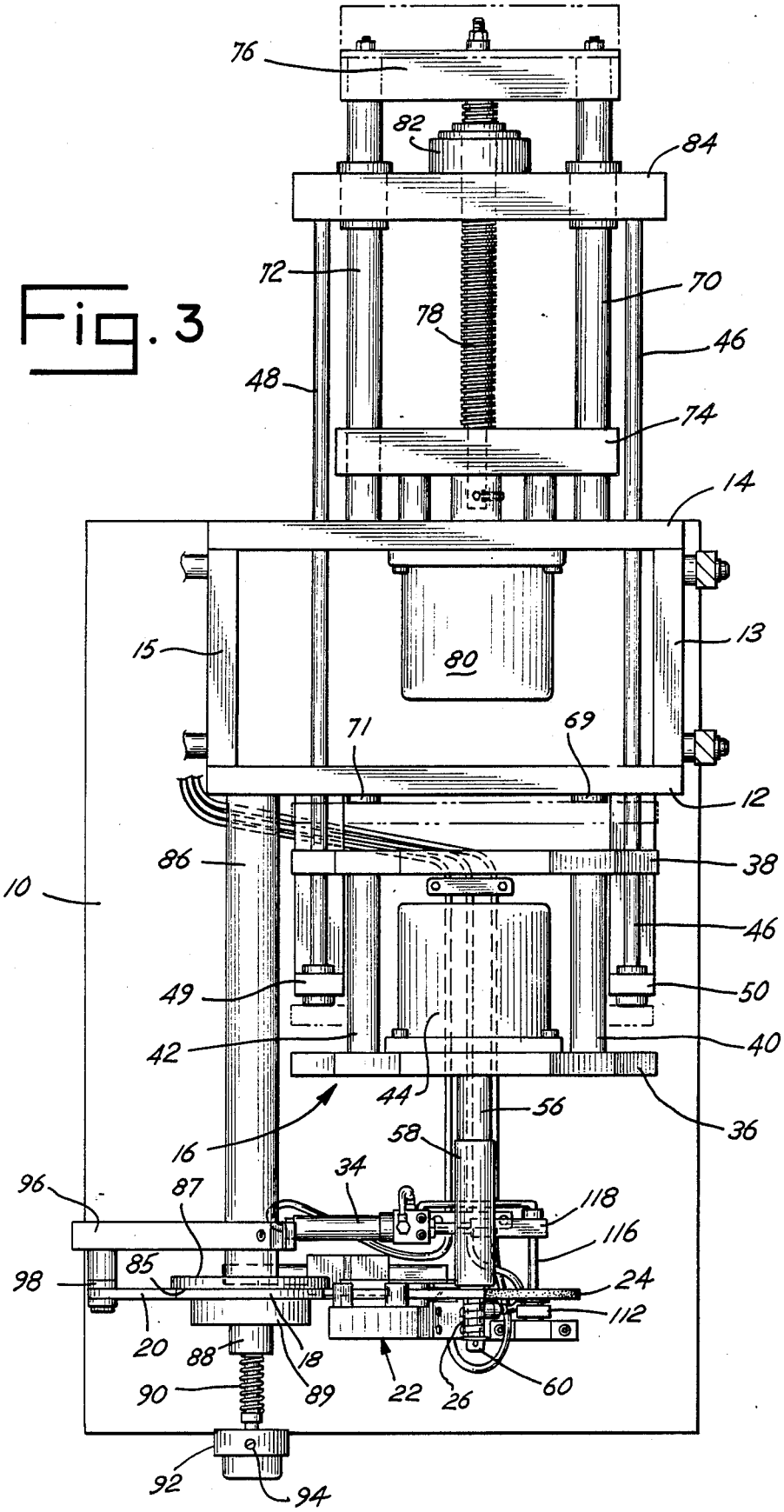
FIG. 3 is a plan view taken along the line 3—3 of FIG. 1.

The drive for moving the carriage back and forth is best shown in plan view FIG. 3. Rods 70, 72 cantilevered rearwardly from the wall 14, support the drive mechanism. A pair of plates 74, 76 are secured to the rods 70, 72 in spaced relation and have bearings in the centers thereof for mounting the screw 78 at its ends. A nut 82 on the screw is secured to the block 84 which contains bearings to permit the block to slide on the rods 70, 72. The screw/nut assembly is sold commercially as a ball screw. In this particular type of screw, the nut contains raceways for ball bearings to permit smooth and almost frictionless rotation of the nut on the screw. The screw 78 is driven by a step motor 80 bolted to frame plate 14 between that plate and plate 12. The rods 46, 48 which carry the carriage 16 extend rearwardly through bearings in the walls 12, 14 and are secured to the block 84. Thus when the screw 78 is turned by the motor, the nut moves along the screw and carries with it the block 84 as well as the rods 46, 48 thus moving the carriage back and forth.

The tape supply roll 18 is rotatably mounted on the shaft 86 cantilevered from the frame member 12. The outer end of the shaft 86 is of reduced diameter and has a tape supply carrier 87 with a shoulder 85 against which the tape supply roll 18 bears. The tape supply carrier also serves to accurately locate the tape supply roll. The shaft 86 is parallel to the chuck 58 and spindle 60. A pressure hub having a large diameter segment 89 bears against the cardboard core of the supply roll. The smaller diameter segment 88 of the pressure hub is in contact with a coil spring 90 which urges the pressure hub into contact with the cardboard core. The compression of the spring 90 and consequently the pressure against the hub is adjustable to provide a braking action on the tape supply roll 18, through adjustable collar 92. The braking of the roll is necessary to control the tension in the tape 20 as it unwinds from the supply roll. Sufficient friction is provided to keep the tape taut.

On the other side of the roll 18 is an arm 96 locked to and extending from the shaft 86. The outer end of the arm 96 carries an idler roll 98 over which the tape is trained as it advances toward the spool 26 on the spindle 60.

Figure 2:
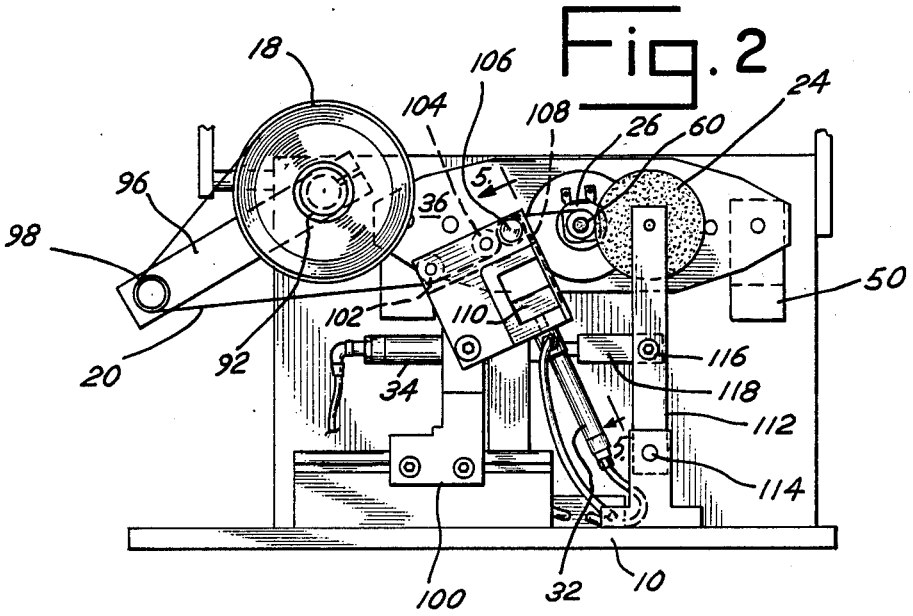
FIG. 2 is a side elevation of the machine of FIG. 1.
Figure 5:
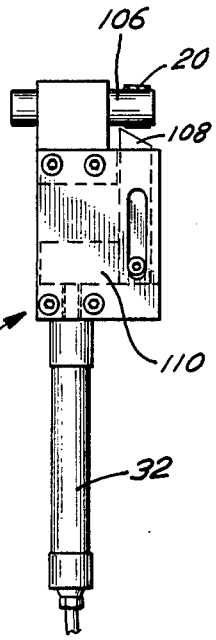
FIG. 5 is a side elevational view of the knife or cutter and the pneumatic cylinder for actuating the knife.
Figure 6:
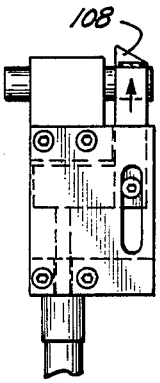
FIG. 6 is a view similar to FIG. 5 partially broken away showing the knife in operative position.

Support 22 is fixed to the base frame 10 through a bracket 100 between the supply roll and the chuck/spindle as best shown in FIG. 2. At the top of the support 22 three tape guide rollers 102, 104, 106 are rotatably mounted for guiding the tape to the spindle and the spool thereon. Rolls 102 and 104 are preferably made from Teflon or similar material to which the tape does not adhere. The roll 106 closest to the spindle is made from Delrin or other suitable material to which the adhesive on the tape will adhere. This is necessary to resist the cutting action of the knife and prevent loss of tape position. On the side of the support 22 nearest the spindle a knife 108 is slidably mounted by means of a block 110 which slides up and down within the support and is connected to a pneumatic cylinder 32 as best shown in FIG. 5. Air to the cylinder is supplied through a solenoid valve (not shown) to move the knife up and down in response to controls synchronized with the motion of the spool on the spindle. The knife moves up to sever the tape 20 after the spool winding has been completed.

Pressure roller 24 is mounted for free rotation on the end of arm 112 pivoted at 114 on T-shaped support secured to the base plate 10. The roller is rubber covered or may be made entirely of rubber and is approximately the same width as the tape 20. To move the roller against the spool 26 arm 116 pivotally connects to arm 118 which in turn connects to the piston shaft in the pneumatic cylinder 34. This cylinder is also controlled through a solenoid valve which actuates the cylinder to move the pressure roller away from the spool and allow for loading or unloading the bobbin. A spring (not shown) brings the pressure roller into contact with the bobbin to ensure a tight connection between the adhesive tape and the wire coiled on the spool.

In setting up for operation, a chuck 58 selected for the size of the spool or bobbin to be tape wound is slid onto the motor shaft adaptor 56 and retained by the set screw. The spool or bobbin 26 carrying the coil of wire is pushed onto the end of the spindle 60 projecting from the end of the chuck. Flange 68 of the spool is seated in the recess 66 of the chuck as shown in FIG. 4. The spool slides over the detent 62 which pops up after the spool has been seated to prevent axial movement off the end of the spindle.

Initially tape 20 from the supply roll 18 is threaded first around the idler roller 98 then under the rollers 102 and 104 and over the roller 106. The end of the tape is pressed manually onto the surface of the wire adjacent the outer flange of the spool. The pressure roller 24 moves into contact with the surface of the tape end on the coil. The motors 44 and 80 are actuated through the controls in the cabinet 30 to rotate the spool and to move the carriage, and hence the spool mounted on the carriage, laterally a distance equal to the distance between the flanges of the spool. This distance is adjustable for spools of different lengths. As viewed in FIG. 3, the carriage moves to the left. When the coil has been completely covered with spirally wound tape, the knife 108 is actuated to sever the tape 20. The carriage is reversed to its starting position. Power to the motors 44 and 80 is cut off. The cylinder 34 is then actuated to move the pressure roller away from the spool.

The taped spool is then removed by sliding it off the end of the spindle 60 and another spool of coiled wire is slid onto the spindle 60. The sequence of operations is repeated.

When the tape has been exhausted a new roll is placed on the machine by removing the collar 92, spring 90 and pressure hub 88, 89. The cardboard core of the exhausted tape supply roll is removed from the tape supply carrier 87 and a new roll is installed.

As indicated, the lateral speed of the carriage is predetermined by the controls so that the spool moves less than the width of the tape per each revolution of the spool. The speed of the carriage is constant, but the speed of rotation of the spindle is adjustable to provide the desired amount of tape overlap. By this means, it is possible to use tape of the same width for any length of spool as well as provide a variation in the extent of spiral overlap. The pressure roller ensures that the tape is adhered not only to the wire, but to the adjacent winding of tape. Since the chuck can be replaced manually by loosening a set screw and sliding the chuck off the adaptor, an operator who is untrained can make a changeover for a different sized bobbin quickly and effectively.

The controls for actuating the step motors and pneumatic cylinders in proper sequence and for adjusting the distance the carriage travels and the speed of rotation of the spindle are not shown in the drawing but are commercially available parts.

What is claimed is:

1. A machine for spirally wrapping ribbon-like insulating adhesive tape on flanged spools wound with coils of wire to insulate the wire, said spools being of various sizes, with one winding of tape overlapping an adjacent winding comprising a chuck detachably secured to a rotatably and axially movable shaft, a spindle comprising part of said chuck and rotatable therewith for mounting the spool, means for locking said spool against rotation with respect to the spindle, a first motor for rotating said shaft, a second motor for moving said shaft axially a predetermined distance, control means for adjusting the speed of the first motor relative to the speed of the second motor to control the amount of said overlap, a fixed shaft disposed parallel to and spaced from said spindle for rotatably mounting a supply roll of said tape, a tape guide roll interposed between said fixed shaft and said spindle, a knife mounted between said tape guide roll and said spindle to cut off the tape from the supply roll, and means for actuating said knife.

2. The machine of claim 1 in which said first motor runs at variable speed and said second motor runs at constant speed.

3. The machine of claim 1 in which said first motor, to which said shaft is connected, is mounted on a laterally moving carriage and said second motor drives said carriage through a screw and a nut.

4. The machine of claim 1 which includes a pressure roller mounted for rotation on the upper end of a vertical arm said pressure roller being located on the side of said spindle opposite said shaft, said arm being pivoted at the lower end thereof, and means for moving said pressure roller about said pivot toward and away from said spindle.

5. The machine of claim 1 wherein said control means includes means for automatically shutting off said motors after said shaft has moved laterally said predetermined distance and returned to its starting position.

6. The machine of claim 1 in which said locking means comprises an element on the end of said chuck for cooperating with a flange on said spool.

7. The machine of claim 6 which includes a detent near the end of said spindle to prevent said spool from moving off the end of said spindle.

8. The machine of claim 6 in which said element is of the same configuration as said spool flange.

9. The machine of claim 1 which includes a support disposed between said fixed shaft and said spindle, a plurality of tape guide rollers mounted on said support, said tape guide roller closest to said spindle being made from a material which adheres to the adhesive on the tape.

* * * * *